US008240831B2

(12) United States Patent
Dixon

(10) Patent No.: US 8,240,831 B2
(45) Date of Patent: Aug. 14, 2012

(54) SYSTEM AND METHOD FOR CONTROLLING INSERTION OF SOLID INK STICKS INTO A PRINTER

(75) Inventor: Timothy James Dixon, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 183 days.

(21) Appl. No.: 12/817,397

(22) Filed: Jun. 17, 2010

(65) Prior Publication Data

US 2011/0310200 A1 Dec. 22, 2011

(51) Int. Cl.
*B41J 2/175* (2006.01)

(52) U.S. Cl. ..... 347/88; 347/99; 347/5

(58) Field of Classification Search ..... 347/5, 88, 347/99

See application file for complete search history.

(56) References Cited

U.S. PATENT DOCUMENTS

| | | | |
|---|---|---|---|
| 5,223,860 | A | 6/1993 | Loofbourow et al. |
| 5,442,387 | A | 8/1995 | Loofbourow et al. |
| 5,510,821 | A | 4/1996 | Jones et al. |
| 5,734,402 | A | 3/1998 | Rousseau et al. |
| 5,861,903 | A | 1/1999 | Crawford et al. |
| 6,056,394 | A | 5/2000 | Rousseau et al. |
| 6,543,867 | B1 | 4/2003 | Jones |
| 6,572,225 | B1 | 6/2003 | Jones |
| 6,679,591 | B2 | 1/2004 | Jones |
| 6,705,710 | B2 | 3/2004 | Reeves et al. |
| 6,709,094 | B2 | 3/2004 | Jones |
| 6,719,413 | B2 | 4/2004 | Jones |
| 6,722,764 | B2 | 4/2004 | Jones et al. |
| 6,893,121 | B2 | 5/2005 | Jones |
| 6,986,570 | B2 | 1/2006 | Jones et al. |
| 7,104,635 | B2 | 9/2006 | Jones |
| 7,883,197 | B2 * | 2/2011 | Mantell et al. ..... 347/88 |

* cited by examiner

*Primary Examiner* — Matthew Luu
*Assistant Examiner* — Rut Patel
(74) *Attorney, Agent, or Firm* — Maginot Moore & Beck, LLP

(57) ABSTRACT

A solid ink printer selectively enables solid ink sticks to be inserted into an insertion port. The solid ink printer includes a plurality of feed channels, each feed channel terminating at a melting device that heats solid ink sticks to a melting temperature at one end of the feed channel, an insertion port operatively connected to another end of each of the plurality of feed channels, the insertion port being configured with an opening through which solid ink sticks are inserted for movement through one of the feed channels operatively connected to the insertion port, a member positioned proximate the opening in the insertion port, an actuator operatively connected to the member and configured to move the member with respect to the opening of the insertion port, and a controller operatively connected to the actuator, the controller being configured to detect at least one event and operate the actuator to move the member to block solid ink sticks from entering through the opening of the insertion port.

27 Claims, 3 Drawing Sheets

SYSTEM AND METHOD FOR CONTROLLING INSERTION OF SOLID INK STICKS INTO A PRINTER

TECHNICAL FIELD

The mechanized insertion port barrier disclosed below generally relates to solid ink printers, and, more particularly, to solid ink printers having multiple feed channels.

BACKGROUND

Solid ink or phase change ink imaging devices, hereafter called solid ink printers, encompass various imaging devices, such as printers and multi-function devices. These printers offer many advantages over other types of image generating devices, such as laser and aqueous inkjet imaging devices. Solid ink or phase change ink printers conventionally receive ink in a solid form, either as pellets or as ink sticks. A color printer typically uses four colors of ink (yellow, cyan, magenta, and black).

The solid ink pellets or ink sticks, hereafter referred to as ink, sticks, or ink sticks, are delivered to a melting device, which is typically coupled to an ink loader, for melting of the solid ink into a liquid. A typical ink loader includes multiple feed channels, one for each color of ink used in the imaging device. In one type of solid ink printers, one common insertion port is provided for all the feed channels. In this type of solid ink printer an ink stick transporter transfers the ink sticks from a staging area to the appropriate feed channel. In another type, each channel has an insertion port in which ink sticks of a particular color are inserted through the insertion port. The ink sticks move either by gravity or urged by a conveyor or a spring-loaded pusher along to the feed channels. Each feed channel directs the solid ink within the channel towards a melting device located at the end of the channel. Each melting device receives solid ink from the feed channel to which the melting device is connected and heats the solid ink impinging on it to convert the solid ink into liquid ink that is delivered to a print head for jetting onto a recording medium or an intermediate transfer surface.

The insertion port or ports of a printer may be covered by a key plate having a keyed opening. The keyed opening helps to ensure a printer user places ink sticks of the correct variety into the insertion port. Each ink stick of a particular color corresponding to a feed channel has a particular shape. In the case of the common insertion port, the keyed opening is configured to accommodate all of the configurations for ink sticks intended for use in the printer. In the case of one insertion port for each feed channel, each insertion port may be keyed to allow only the ink sticks corresponding to the associated feed channel.

As the number of pages printed per minute increases for solid ink printers so does the demand for ink in the printer. To supply larger amounts of ink to printers, the cross-sectional area of the feed channels may be increased. Consequently, the insertion port for the channels and the keyed plate covering the insertion port are likewise enlarged. The larger opening enables smaller solid ink sticks to pass through without engaging the keyed plates over the insertion ports. Thus, solid ink sticks that do not conform to the appropriate colors for the feed channels can be loaded into the feed channel and delivered to the melting devices at the end of the feed channels. Even if a smaller stick has the correct color for the feed channel, its size may impair the ability of the stick to cooperate with guiding structure within the feed channel. Thus, excluding ink sticks that are not configured for use in a feed channel at the insertion port is a desirable goal.

Furthermore, situations arise in which the insertion of ink sticks into the insertion port is not optimal. For example, the insertion of several ink sticks of the same color into an insertion port may result in a back log of these sticks if the feed channel corresponding to the color of these ink sticks is already full. The issue of improper loading of ink sticks can be partially addressed by displaying messages on a printer screen. When the printer is powered down, however, the screen is blank and the printer cannot notify an operator that loading ink sticks corresponding to the filled feed channel would be improper.

SUMMARY

According to the present disclosure, a solid ink printer having a single insertion port incorporates a mechanism that controls the insertion of solid ink sticks into the printer selectively. The solid ink printer includes a plurality of feed channels, each feed channel terminating at a melting device that heats solid ink sticks to a melting temperature at one end of the feed channel, an insertion port operatively connected to another end of each of the plurality of feed channels, the insertion port being configured with an opening through which solid ink sticks are inserted for movement through one of the feed channels operatively connected to the insertion port, a member positioned proximate the opening in the insertion port, an actuator operatively connected to the member and configured to move the member with respect to the opening of the insertion port, and a controller operatively connected to the actuator, the controller being configured to detect at least one event and operate the actuator to move the member to block solid ink sticks from entering through the opening of the insertion port.

According to the present disclosure, a solid ink printer having an insertion port for each feed channel incorporates a mechanism for each insertion port that controls the insertion of solid ink sticks into the printer selectively. The solid ink printer includes a plurality of feed channels, each feed channel having an insertion port operatively connected to one end of each of the plurality of feed channels and a melting device that heats solid ink sticks to a melting temperature at another end of the feed channel, each insertion port being configured with an opening through which solid ink sticks are inserted for movement through one of the feed channels operatively connected to the insertion port, a member positioned proximate the opening in each insertion port and configured to be moveable with respect to the opening of the insertion port, an actuator coupled to each member, each actuator configured to move an associated member with respect to the opening of an associated insertion port, and a controller operatively connected to each actuator, the controller being configured to detect at least one event and operate the actuators to move the members to block solid ink sticks from entering through the openings of the insertion ports.

BRIEF DESCRIPTION OF THE DRAWINGS

Features for enabling passage of solid ink from an insertion port at one end of a feed channel in a solid ink printer to the feed channel are discussed with reference to the drawings, in which.

DETAILED DESCRIPTION

The term "printer" refers, for example, to reproduction devices in general, such as printers, facsimile machines, copiers, and related multi-function products.

Figure 1:
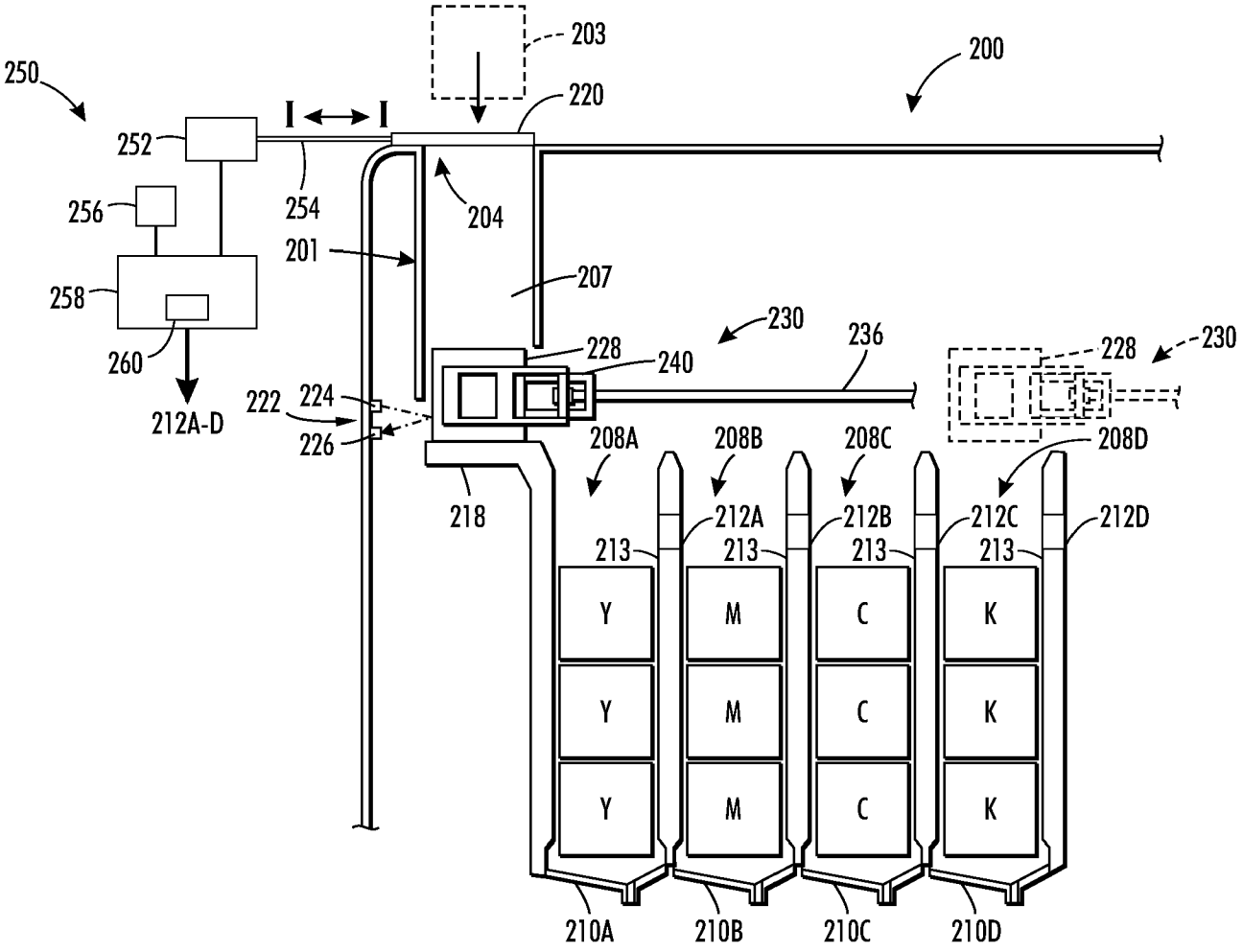
FIG. 1 is a side view of vertically oriented feed channels in a solid ink printer with a common insertion port and a passage barrier for selectively enabling ink sticks to enter the insertion port.

An embodiment of a system 200 for identifying and moving solid ink sticks inserted into a common insertion port is shown in FIG. 1. The system 200 includes a staging column 201, an insertion port barrier assembly 250, an optical ink stick recognition assembly 222, an ink stick transporter 230, and four feed channels 208A, 208B, 208C, and 208D. The staging column 201 is defined by the insertion port 204 at one end, includes side walls 207, and terminates at a landing ledge 218, which is configured to hold an ink stick 228 until the ink stick 228 is identified and moved to the appropriate feed channel 208A-D.

The insertion port barrier assembly 250 includes an actuator 252, a linkage 254 and a member 220 that acts as a barrier to the insertion port when the member is positioned across the opening of the port 204. The actuator 252 is connected to a controller 258, which operates the actuator 252. The controller 258 provides an actuation signal to the actuator 252 based on detection of at least one event (described further below). The barrier 252 is connected to the actuator 252 by the linkage 254. The actuator 252 under the control of the controller 258 moves the barrier 220 in the direction of arrow I-I to allow selective access to the common insertion port 204 and the staging column 201. The actuator 252 may include a stepping motor, a direct current motor, an alternating current motor or other electromechanical sources of motive force such as a spring-loaded solenoid. As used in this document, actuator refers to any electromechanical device that produces mechanical movement in response to an electrical signal. The linkage that operatively connects the mechanical movement of the actuator to the moveable member may be a continuous belt assembly, a continuous screw, a cam, a chain, or a solid link. The operation of the insertion port barrier assembly 250 is described in greater detail below.

The optical recognition assembly 222 includes an optical source 224 and an optical detector 226, which are both proximate the landing ledge 218. The optical recognition assembly 222 is enabled to obtain identification data (e.g., a bar code, color identification, etc.) from the ink stick 228 positioned on the landing ledge 218 and provide it to the controller 258 in the printer. In the embodiment shown in FIG. 1, the optical source 224 illuminates the solid ink stick 228 resting on the ledge 218 and the optical detector 226 receives reflected light from the illuminated surface of the ink stick 228. In response to the reflected light, the optical detector generates an electrical signal corresponding to the identification data on the solid ink stick 228.

To identify whether an ink stick corresponds to one of the feed channels in the printer 100, the controller 258 receives the electrical signal from the optical recognition assembly 222 and compares the identification data obtained from the electrical signal to identification data for ink sticks stored in a memory 260 of the controller 258. If the identification data obtained from the solid ink stick corresponds to the stored identification data, the controller 258 operates the ink stick transporter 230, as described more fully below, to move the ink stick to the feed channel corresponding to the identification data for the identified ink stick.

While an optical sensor is shown in FIG. 1, an electromechanical discriminator can also be used to distinguish between different color ink sticks, each color ink stick having particular mechanical features. These features can be used to mechanically identify the ink stick using the electromechanical reader having springs and electrical contact that are activated as the springs interact with indentations and protrusion provided on the ink sticks.

The feed channels 208A-D each can hold several ink sticks. A color printer typically uses four colors of ink (yellow, cyan, magenta, and black). Ink sticks of each color are delivered through a corresponding individual one of the feed channels 208A-D. Each feed channel 208A, 208B, 208C, and 208D terminates in melting devices 210A, 210B, 210C, and 210D, respectively. Also, each feed channel 208A-D is confined by side walls 213. Toward the top portion of one side wall 213 of each feed channel 208A, 208B, 208C, and 208D is an ink stick detector 212A, 212B, 212C, and 212D, respectively. Each ink stick detector 212A-D is configured to produce a signal indicative of a feed channel being full of solid ink sticks. Each ink stick detector 212A-D is connected to the controller 258. In response to the controller 258 receiving from any ink stick detector 212A-D the signal indicative of a feed channel being full of solid ink sticks, the controller 258 activates the actuator 252 to move the member 220 into position to block access to the port 204. The melt devices 210A-D are also connected and controlled by the controller 258.

The ink stick transporter 230 transports an ink stick 228 that has entered the staging column through the common insertion port 204 and is resting on a landing ledge to the appropriate feed channel. The ink stick transporter 230 is operatively connected to and operated by the controller 258. The controller 258 determines the color of the ink stick 228 and directs the ink stick transporter 230 to move the ink stick to a space above the correct feed channel and to drop the ink stick 228 into the feed channel.

The transporter 230 includes a drive mechanism 236 and a solid ink stick clamp 240. In response to the ink stick identification process (described below) the controller 258 performing the identification process activates the motive force for the drive mechanism 236 to move the clamp 240 towards the ink stick 228. In response to a signal from the controller 258 indicating the identification process is complete, jaws of the clamp 240 are clamped against the ink stick 228 and the drive mechanism is reversed. This operation removes the solid ink stick 228 from the landing ledge 218 and carries the solid ink stick in the jaws of the clamp 240 along a path that is above the feed channels 208A, 208B, 208C, and 208D. The controller 258 stops the drive mechanism 236 when the stick in the clamp 240 has traveled a predetermined distance or time that corresponds to the location of the feed channel for the type of stick identified in the identification process. The clamp 240 is then opened to release the ink stick so it falls into the corresponding feed channel 208A-D.

In operation, the actuator 252 may be configured to place the barrier in a closed position (i.e., to deny access to the insertion port 204) as the default position of the barrier 220. The controller 258 receives signals from the ink stick detector 212A-D and from a sensor 256 that is operatively connected to an electrical power line in the printer. The controller 258 provides an actuation signal to the actuator 252 to move the member from the port 204 in response to two conditions being detected. First, power must be provided to the printer. As soon as a loss of power is detected within the printer, the controller 258 ceases to provide the actuation signal and the member 220 returns to the blocking position. The loss of power is detected in one of two modes. In the first mode, electrical power may be suddenly disconnected from the printer, for example, by unplugging the printer from an electrical outlet. In the second mode, a printer operator may shut the printer down in a controlled manner. The controlled shut down may be achieved by the operator entering appropriate commands to a printer interface requesting the printer to be shut down.

Second, the controller 258 ceases to generate the actuation signal when one of the ink stick detectors 212A-D indicates the corresponding feed channels is full of ink sticks. Therefore, in response to at least one of the ink stick detectors 212A-D generating a signal indicative the corresponding feed channel is full, the controller 258 ceases to generate the actuation signal and the actuator 252 leaves the member 220 in the blocking position across the opening in the port 204. When the printer is powered and none of the ink sticks detectors generate a signal indicating the feed channel is full of solid ink sticks, the controller generates the actuation signal and the actuator moves the member 220 to enable a solid ink stick to be inserted into the port 204.

As described above, the actuator 252 forces the barrier 220 to a default blocking position. Therefore, even if the controller 258 is generating an actuation signal to the actuator 252 to place the barrier in the open position, loss of power to the printer causes the actuator 252 to place the barrier 220 in its default closed position automatically. In one embodiment, this operation is achieved by using a spring-biased solenoid for the actuator 252. In another embodiment, a spring (not shown) may be coupled to the linkage 254 to bias the barrier 220 into the blocking position. Only when the controller 258 provides the appropriate signal to the actuator 252, the actuator overcomes the biasing force of the spring (not shown) and moves the barrier 220 to a position that enables solid ink sticks to be inserted into the insertion port.

Figure 2:
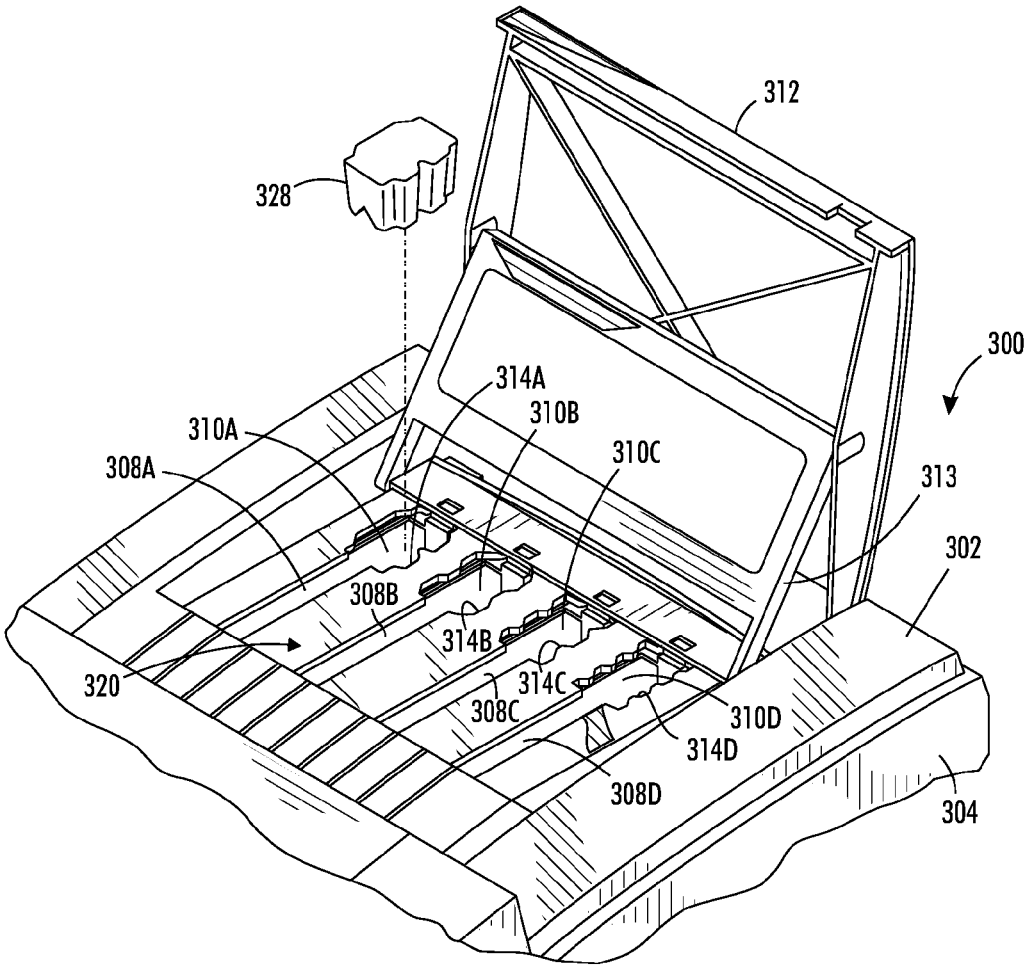
FIG. 2 is an enlarged partial top perspective view of a solid ink printer according to one embodiment with an ink access cover open, showing multiple insertion ports, with each insertion port leading to a corresponding feed channel, and a solid ink stick in position to be loaded into one of insertion ports.

In another embodiment of a solid ink printer shown in FIG. 2, a printer 300 includes one insertion port 310A-D for each feed channel 308A-D. The printer 300 includes a housing having a top surface 302 and a side surface 304. As ink access cover 312 is attached to an ink load linkage element 313 so that when the printer ink access cover 312 is raised, the ink load linkage 313 slides and pivots to an ink load position. As seen in FIG. 2, opening the ink access cover reveals a key plate 320 having keyed openings 314A-D above a respective insertion port 310A-D. Each keyed opening 314A, 314B, 314C, and 314D provides access to a feed channel 308A, 308B, 308C, and 308D, respectively.

The keyed openings 314A, 314B, 314C, and 314D of the key plate 320 aid the printer user in ensuring that only ink sticks of the proper color are inserted into each feed channel. Each keyed opening 314A, 314B, 314C, and 314D of the key plate 320 has a unique shape. The ink sticks also have unique shapes that correspond to the shapes of the keyed openings. The combination of the keyed openings and corresponding ink stick shapes exclude from each ink feed channel ink sticks of all colors except the ink sticks of the proper color for that feed channel.

Figure 3:
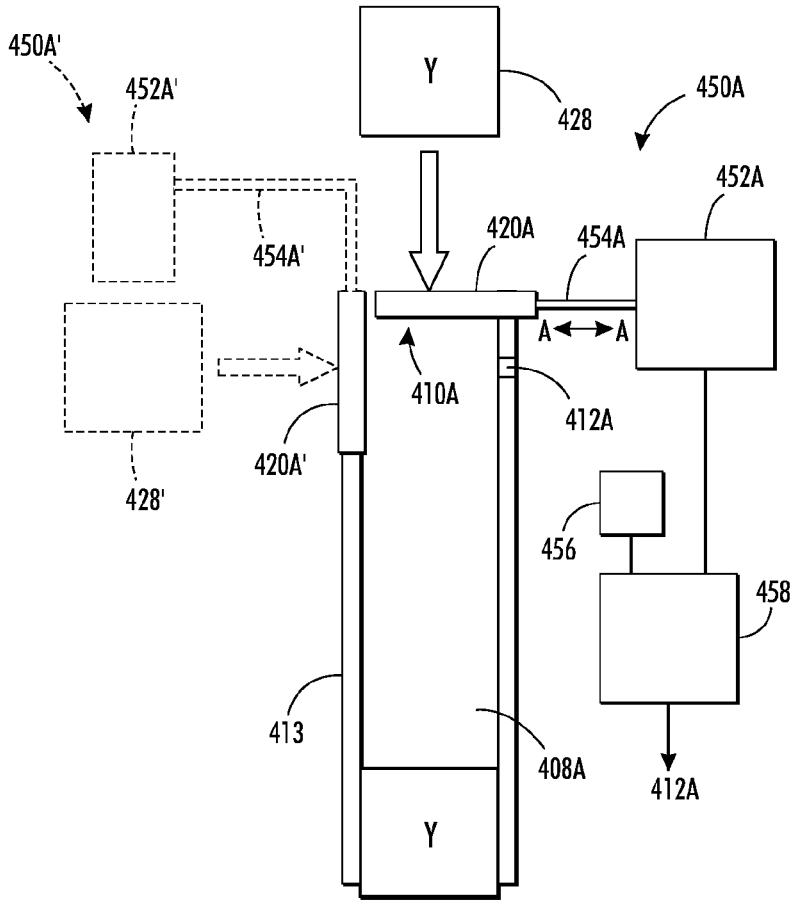
FIG. 3 is a side view of one of the insertion ports-feed channels depicted in FIG. 2, with a barrier depicted for selectively enabling ink sticks to be inserted into the insertion port.

FIG. 3 shows one of the feed channels 408A along with a corresponding insertion port barrier assembly 450A. In this embodiment, the staging column is eliminated and the insertion port 410A defines one end of the feed channel 408A, while a melting device (not shown) defines the other end of the feed channel 408A. The melting device heats a solid ink stick in the feed channel 408A impinging on the melting device to a melting temperature.

The insertion port barrier assembly 450A includes a member 420A that is selectively operated to form a barrier to the insertion port 410A, an actuator 452A, and a linkage 454A. The barrier 420A is operatively connected to the feed channel 408A and is moveable in the direction of arrow A-A to provide selective entry or exit of an ink stick 428 into or out of the insertion port 410A. The barrier 420A is connected to the actuator 452A via the linkage 454A. The actuator 452A is connected to a controller 458 which may be common to all actuators (i.e., 452A-D). The controller 458 is also connected to a sensor 456 and to an ink stick detector 412A. The sensor 456 is operatively connected to an electrical power line in the printer and generates a signal indicative of electrical power being supplied to the printer. The ink stick detector 412A is positioned toward the top of the feed channel 408A and is configured to generate an electrical signal indicative of the feed channel 408A being full of ink sticks when an ink stick is proximate to the ink stick detector 412A. The opening in the insertion port 410A may be positioned to be either aligned or transverse to the direction of solid ink stick movement through the feed channel 408A. The transverse direction is identified by insertion port barrier assembly 450A' which includes an actuator 452A', a linkage 454A', and a barrier 420A' for selective entry or exit of the ink stick 428'.

Figure 4:
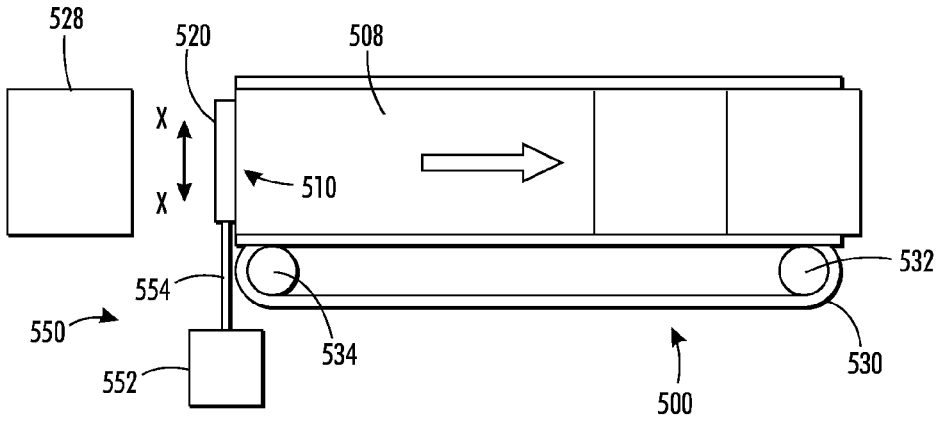
FIG. 4 is a side view of a horizontally oriented feed channel having a passage barrier and a mechanized carrier for transporting the ink sticks from the insertion port to a melting device.

As shown in FIG. 3, gravity moves the ink stick 428 into and within the feed channel 408A in response to the barrier 420 being moved to an open position. In another embodiment shown in FIG. 4, a motorized system 500 moves ink sticks within a feed channel 508 from an insertion port 510. A barrier 520 moves in the direction of the arrow X-X to provide or deny access to the insertion port 510. The barrier 520 is connected to an actuator 552 by a linkage 554 so that the barrier 510 can be moved into a closed position (i.e., deny access to the insertion port 520). Movement of the ink stick from the insertion port 510 into the feed channel 508 and further toward a melting device (not shown) is performed by the endless belt conveyor 530 disposed between rollers 532 and 534. A motor or other actuator operating the conveyor 540 may be energized by a controller in response to an ink stick being identified as being present at the insertion port 510 by a sensor, e.g., an optical sensor, positioned at the insertion port 510.

In operation with reference to FIG. 3, similar to the operational description provided above with reference to FIG. 1, the controller 458 provides actuation signals to the actuator 452A-D to move the members 420A-D to positions that enable solid ink sticks to be inserted in the insertion ports 410A-D when two conditions are occurring. First, power must be provided to the printer. As soon as a loss of electrical power is detected within the printer, the controllers 458 ceases to provide the actuation signals and the members 420A-D return to the blocking positions, which are the default positions of the members 420A-D. As discussed above, the loss of power is detected in one of two modes. In the first mode, electrical power may be suddenly disconnected from the printer. In the second mode, the printer operator may shut the printer down in a controlled manner.

Second, with electrical power being supplied to the printer, the controller 458 ceases to generate an actuation signal when an ink stick detector 412A-D indicates the corresponding feed channel is full of ink sticks. Therefore, in response to one of the ink stick detectors 412A-D generating a signal indicative the corresponding feed channel is full, the controller 458 ceases to generate the actuation signal to the corresponding actuator 452A-D and the actuator leaves the member 420A-D in the blocking position across the opening in the corresponding port 410A-D.

While FIGS. 1 and 2 depict multiple feed channels, the reader should appreciate that in a single color printer only one feed channel may be provided. In the single feed channel embodiment, one insertion port provides selective access to the feed channel in a manner similar to one of the feed channels 308A-D in FIG. 2.

In one embodiment with reference to FIG. 1, an ejection scheme (not shown) may be used to eject an ink stick that is inserted into the insertion port 204. The ejection scheme may include an ejection channel, e.g., parallel to the feed channels 208A-D which leads to an ejection port. One situation where the ejection scheme may be used is where one of the feed channels 208A-D is empty and the printer is requesting the operator to insert an ink stick corresponding to the empty feed channel. However, the operator inserts an incorrect ink stick (i.e., an ink stick corresponding to another feed channel) that fills that feed channel. Once the controller 258 recognizes an incorrect ink stick has been inserted, the controller provides the appropriate signal to the transporter 230 to guide the incorrect ink stick to the ejection channel and to the ejection port. This operation enables the operator to insert an ink stick corresponding to the empty feed channel.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

I claim:

1. A solid ink printer comprising:

a plurality of feed channels, each feed channel terminating at a melting device that heats solid ink sticks to a melting temperature at one end of the feed channel;

an insertion port operatively connected to another end of each of the plurality of feed channels, the insertion port being configured with an opening through which solid ink sticks are inserted for movement through one of the feed channels operatively connected to the insertion port;

a member positioned proximate the opening in the insertion port;

an actuator operatively connected to the member and configured to move the member with respect to the opening of the insertion port, the actuator being operatively connected to the member by one of a continuous belt assembly, a continuous screw, a cam, and a chain; and a controller operatively connected to the actuator, the controller being configured to detect at least one event and operate the actuator to move the member to block solid ink sticks from entering through the opening of the insertion port.

2. The printer of claim 1, the controller being further configured to detect a plurality of events.

3. The printer of claim 2, the controller being further configured to operate the actuator to block the opening in the insertion port in response to detection of a loss of electrical power to the printer and in response to a feed channel being full.

4. The printer of claim 3 further comprising:

a sensor operatively connected to an electrical power line in the printer and to the controller, the sensor is configured to generate a signal indicative of electrical power being supplied to the printer; and the controller being configured to operate the actuator to move the member and block the opening in the insertion port in response to the sensor ceasing to generate the signal indicative of electrical power being supplied to the printer.

5. The printer of claim 3, the controller being configured to operate the actuator to move the member and block the opening in the insertion port in response to the printer being shut down in a controlled manner.

6. The printer of claim 3 further comprising:

a plurality of solid ink stick detectors, a solid ink stick detector being positioned proximate a feed channel to detect a solid ink stick at a position indicative of a feed channel being full of solid ink sticks, each sensor being operatively connected to the controller and configured to generate a signal indicative of whether the feed channel at which the solid ink stick detector is positioned is full of solid ink sticks; and the controller being configured to operate the actuator to move the member and block the opening in the insertion port in response to receipt of the signal from one of the solid ink stick detectors indicating one of the feed channels is full of solid ink sticks.

7. The printer of claim 1 wherein the actuator is one of a stepper motor, a direct current motor, an alternating current motor, and a spring loaded solenoid.

8. The printer of claim 1 wherein the opening in the insertion port is configured to receive solid ink sticks in a direction transverse to a direction of solid ink stick movement through the plurality of feed channels.

9. The printer of claim 1 wherein the opening in the insertion port is configured to receive solid ink sticks in a direction aligned with a direction of solid ink stick movement through the plurality of feed channels.

10. A solid ink printer comprising:

a plurality of feed channels, each feed channel having an insertion port operatively connected to one end of each of the plurality of feed channels and a melting device that heats solid ink sticks to a melting temperature at another end of the feed channel, each insertion port being configured with an opening through which solid ink sticks are inserted for movement through one of the feed channels operatively connected to the insertion port, each opening in each insertion port is configured to receive solid ink sticks in a direction transverse to a direction of solid ink stick movement through the plurality of feed channels;

a member positioned proximate the opening in each insertion port and configured to be moveable with respect to the opening of the insertion port;

an actuator coupled to each member, each actuator configured to move an associated member with respect to the opening of an associated insertion port; and a controller operatively connected to each actuator, the controller being configured to detect at least one event and operate the actuators to move the members to block solid ink sticks from entering through the openings of the insertion ports.

11. The printer of claim 10, the controller being further configured to detect a plurality of events.

12. The printer of claim 11, the controller being further configured to operate each actuator to block the associate opening in the associated insertion port in response to detection of a loss of electrical power to the printer and in response to the associated feed channel being full.

13. The printer of claim 12 further comprising:

a sensor operatively connected to an electrical power line in the printer and to the controller, the sensor is configured to generate a signal indicative of electrical power being supplied to the printer; and the controller being configured to operate the actuators to move the members and block the openings in the insertion ports in response to the sensor ceasing to generate the signal indicative of electrical power being supplied to the printer.

14. The printer of claim 12, the controller being configured to operate the actuators to move the members and block the openings in the insertion ports in response to the printer being shut down in a controlled manner.

15. The printer of claim 12 further comprising:

a plurality of solid ink stick detectors, each solid ink stick detector being positioned proximate a feed channel to detect a solid ink stick at a position indicative of a feed channel being full of solid ink sticks, each solid ink stick detector being operatively connected to the controller and configured to generate a signal indicative of whether the feed channel at which the solid ink stick detector is positioned is full of solid ink sticks; and the controller being configured to operate each actuator to move the associated member and block the associated opening in the insertion port in response to receipt of the associated signal from the associated solid ink stick detector indicating the associated feed channel is full of solid ink sticks.

16. The printer of claim 10 wherein each actuator is one of a stepper motor, a direct current motor, an alternating current motor, and a spring loaded solenoid.

17. The printer of claim 10, wherein each actuator is operatively connected to the member by one of a continuous belt assembly, a continuous screw, a cam, a chain, and a solid link.

18. The printer of claim 10 wherein each opening in each insertion port is configured to receive solid ink sticks in a direction aligned with a direction of solid ink stick movement through the plurality of feed channels.

19. A solid ink printer comprising:

a plurality of feed channels, each feed channel terminating at a melting device that heats solid ink sticks to a melting temperature at one end of the feed channel;

an insertion port operatively connected to another end of each of the plurality of feed channels, the insertion port being configured with an opening through which solid ink sticks are inserted for movement through one of the feed channels operatively connected to the insertion port, the opening in the insertion port is configured to receive solid ink sticks in a direction transverse to a direction of solid ink stick movement through the plurality of feed channels;

a member positioned proximate the opening in the insertion port;

an actuator operatively connected to the member and configured to move the member with respect to the opening of the insertion port; and a controller operatively connected to the actuator, the controller being configured to detect at least one event and operate the actuator to move the member to block solid ink sticks from entering through the opening of the insertion port.

20. The printer of claim 19, the controller being further configured to detect a plurality of events.

21. The printer of claim 20, the controller being further configured to operate the actuator to block the opening in the insertion port in response to detection of a loss of electrical power to the printer and in response to a feed channel being full.

22. The printer of claim 21 further comprising:

a sensor operatively connected to an electrical power line in the printer and to the controller, the sensor is configured to generate a signal indicative of electrical power being supplied to the printer; and the controller being configured to operate the actuator to move the member and block the opening in the insertion port in response to the sensor ceasing to generate the signal indicative of electrical power being supplied to the printer.

23. The printer of claim 21, the controller being configured to operate the actuator to move the member and block the opening in the insertion port in response to the printer being shut down in a controlled manner.

24. The printer of claim 21 further comprising:

a plurality of solid ink stick detectors, a solid ink stick detector being positioned proximate a feed channel to detect a solid ink stick at a position indicative of a feed channel being full of solid ink sticks, each sensor being operatively connected to the controller and configured to generate a signal indicative of whether the feed channel at which the solid ink stick detector is positioned is full of solid ink sticks; and the controller being configured to operate the actuator to move the member and block the opening in the insertion port in response to receipt of the signal from one of the solid ink stick detectors indicating one of the feed channels is full of solid ink sticks.

25. The printer of claim 19 wherein the actuator is one of a stepper motor, a direct current motor, an alternating current motor, and a spring loaded solenoid.

26. The printer of claim 19, wherein the actuator is operatively connected to the member by one of a continuous belt assembly, a continuous screw, a cam, and a chain.

27. The printer of claim 19 wherein the opening in the insertion port is configured to receive solid ink sticks in a direction aligned with a direction of solid ink stick movement through the plurality of feed channels.

* * * * *